US008161884B1

(12) United States Patent
Kokodis et al.

(10) Patent No.: US 8,161,884 B1
(45) Date of Patent: Apr. 24, 2012

(54) SYSTEM AND METHOD FOR EXPLOSIVELY STAMPING A SELECTIVE FRAGMENTATION PATTERN

(75) Inventors: Victor Kokodis, Wharton, NJ (US); George Sudol, Kenvil, NJ (US); Brian Fuchs, Hackettstown, NJ (US); Amy Wilson, Blairstown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 12/980,707

(22) Filed: Dec. 29, 2010

Related U.S. Application Data

(63) Continuation-in-part of application No. 11/977,305, filed on Oct. 22, 2007, now abandoned.

(51) Int. Cl.
*F42B 12/22* (2006.01)

(52) U.S. Cl. ..... 102/493; 102/476; 102/494; 102/495; 102/492; 89/53

(58) Field of Classification Search ..... 102/476, 102/493, 491, 492, 506, 306, 331; 86/10, 86/17, 18, 53
See application file for complete search history.

(56) References Cited

U.S. PATENT DOCUMENTS 3,877,376 A * 4/1975 Kupelian ..... 102/492
4,516,501 A * 5/1985 Held et al. ..... 102/496
5,544,589 A * 8/1996 Held ..... 102/492

* cited by examiner

*Primary Examiner* — Michael Carone
*Assistant Examiner* — Daniel Troy
(74) *Attorney, Agent, or Firm* — Michael C. Sachs

(57) ABSTRACT

A selective fragmentation pattern of explosive material is applied to a surface of a munition. None, some, or all of the explosive material in the selective fragmentation pattern may be detonated, selectively stamping the surface of the munition with the detonated explosive material. The portion of the selective fragmentation pattern selected for ignition is determined by lethality requirements of a target of the munition. Upon detonation of the munition, fragments are formed based on the selected portion of the selective fragmentation pattern. Consequently, igniting all, some, or none of the selective fragmentation pattern may vary lethality of a munition and one munition may be used for a wide range of lethality.

7 Claims, 11 Drawing Sheets

SYSTEM AND METHOD FOR EXPLOSIVELY STAMPING A SELECTIVE FRAGMENTATION PATTERN

RELATION TO OTHER APPLICATIONS

This application is a continuation-in-part from application Ser. No. 11/977,305; filing date: Oct. 22, 2007 now abandoned; entitled "System And Method For Explosively Stamping A Selective Fragmentation Pattern", by the same inventors.

U.S. GOVERNMENTAL INTEREST

The inventions described herein may be manufactured, used and licensed by or for the U.S. Government for U.S. Government purposes.

FIELD OF THE INVENTION

The present invention generally relates to the field of ballistics, and in particular relates to explosively formed projectiles and munition casings. More particularly, the present invention pertains to using an explosive material to stamp a pattern on an explosively formed projectile or munition casing to fragment to cause the explosively formed projectile or munition to effect the production of fragments when the munition is exploded.

BACKGROUND OF THE INVENTION

An explosively formed projectile or penetrator (EFP) uses an explosive energy to deform a metal plate into a coherent penetrator while simultaneously accelerating the coherent penetrator to extremely high velocities, employing a kinetic energy penetrator without the necessity of a large gun. A conventional explosively formed projectile is comprised of one or more metallic liners, a case, an explosive section, and an initiation train. Typically, the explosively formed projectile comprises a retaining ring to position and hold the liner-explosive subassembly in place. Explosively formed projectiles produce one or more massive, high velocity penetrators. After detonation, the explosive products create enormous pressures that accelerate one or more liners while simultaneously reshaping the liners into a rod or some other desired shape. The explosively formed penetrator then impacts the target at a high speed, delivering significantly high mechanical power.

An EFP warhead configuration typically comprises a steel case, a high-explosive charge, and a metallic liner. Explosively formed projectile warheads have been designed to project one or more high velocity projectiles to attack armored targets. Currently, each type of EFP warhead is designed for a specific set of targets and a specific lethality range. For example, a larger, more massive EFP warhead is used for heavily armored targets such as tanks, while lightly armored targets require a smaller, less massive EFP.

The overall limited functionality of an EFP warhead requires duplication of munitions during deployment, increasing the complexity of planning for a deployment, decreasing the number of each type of EFP warhead required, and increasing the complexity of engaging an enemy.

Conventional EFP warhead configurations comprise fragmentation techniques to expand the set of targets for a specific EFP warhead. Although this technology has proven to be useful, it would be desirable to present additional improvements. One fragmentation technique requires intricate forming or machining of the metallic liner to form, when exploded, a center slug with a concentric ring of fragments. Although the lighter weight fragments formed by this EFP warhead are suitable for softer targets, this approach reduces the amount of mass available for the center slug, reducing the lethality against harder targets. In this approach, the fragmentation pattern is fixed during manufacture and cannot be changed during deployment.

Another fragmentation technique places a large mesh screen in front of the metallic liner. When exploded, the metallic liner impacts and passes through the screen, fragmenting the metallic liner. This approach allows a specific EFP warhead to be deployed, without the screen, against a heavily armored target and, with the screen, against a softer target. However a complex release mechanism is required to release the screen when the screen is not desired.

Fragmentation techniques are also used on munitions casings to generate case fragmentation during deployment of a munition, increasing the effectiveness of the munition against a variety of targets. Although this technology has proven to be useful, it would be desirable to present additional improvements. Conventional techniques for producing case fragmentation require a multi-step process that can be complex and costly. In one approach, a flat metal sheet is embossed and formed into the cylindrical portion of the casing. In another approach, the cylindrical portion of the casing is broached in a complex two-step process. In both approaches, the fragmentation pattern is fixed during manufacture and cannot be changed during deployment to meet the lethality requirements of a variety of targets.

What is therefore needed is a fragmentation technique that introduces versatility and selectivity in the output of an EFP warhead or munition casing, providing an EFP warhead or munition with variable and selectable lethality for deployment against a variety of targets. Thus, there is a need for a system and method for explosively stamping a selective fragmentation pattern. The need for such a system has heretofore remained unsatisfied.

SUMMARY OF THE INVENTION

The present invention satisfies this need, and presents a system and an associated method (collectively referred to herein as "the system" or "the present system") for explosively stamping a selective fragmentation pattern.

The present system comprises an explosive material, permanently applied to a surface of a munition in a predetermined selective fragmentation pattern. The applied material is allowed to dry, and permanently remain on such surface, in such pattern. Some or all of the explosive material in the selective fragmentation pattern may then be ignited, which selectively "stamps" or "etches" the surface of the munition where the explosive material is ignited, into such desired patterns. The portion of the selective fragmentation pattern selected for ignition is determined by lethality requirements of the target of the munition. Then, upon later detonation of the entire munition, fragments are formed based on the selected pattern. Consequently, igniting all, some, or none of the selective explosive material will affect a particular selected fragmentation pattern, and may vary lethality of a munition to achieve a wide range of target objectives. The ignition of the explosive material described herein is regularly done to an already fully manufactured and assembled said munition and such ignition may be done long before, but also may be done just a split second before, or milliseconds before, e.g., the main explosive charge of the munition is to be detonated. Such pre-ignition makes it possible for a pattern to stamp/etch an inside of the munition casing; such may be selected and accomplished by electrical signals to deliver current to a point or points on the explosive material to initiate ignition thereof at such point(s). The general pattern(s) desired for the explosive material are pre-applied to the munition; the pattern or pattern(s) are permanently applied as for example by painting on a pattern of explosive material that dries and permanently remains on the munition in such pattern(s). The outside of the device rather than the inside of the device may also be instead the surface to which the explosive material pattern is applied (or painted on) and then ignited in the same way to etch the outside surface thereof, and the invention will also function satisfactorily nonetheless, to fragment the munition along such desired pattern(s). The explosive pattern may be all/partially ignited as desired (selected). The selection is done by activating an electrical signal, such as by digital or other circuit means, at selective points on the explosive pattern, simultaneously or consecutively if desired. The entire munition is usually manufactured to have the explosive material (in a pattern) already on the inside (or outside) of the munition; but instead the explosive material could be added on later, such as on the outside of the munition. Ignition of the explosive pattern in an already assembled munition (or already flying munition) is not violent enough so as to destroy or cause full explosion of the munition in any way. Such ignition of the explosive material would merely cause an etching on the selected surface (usually an interior surface) of the munition. The munition would still be intact. As mentioned, such ignition could be done while the munition is already in flight, even microseconds to milliseconds before the munition main explosive charge is to be detonated such as while homing in on a particular target. The decision of when to ignite the explosive material, and in what patterns, can be done automatically/manually in flight, when the nature of the target is discerned either automatically/manually such as by target detection equipment. As mentioned the pre-ignition creates etching which forms slight trenches on the (inside) surface of the munition shell. (The etching could instead be arranged to be on the outside surface of the munition, or on both inside and outside if desired). The eventual fragmentation will be generally along the lines of such trenches. In another approach, the pre-ignition of the explosive material (causing etching) can be done well before use and detonation of the munition, such as six months or a longer time before use, once a mission need is decided upon, for instance. U.S. Pat. No. 3,877,376 issued Apr. 15, 1975 to Vahey Kupelian, and U.S. Pat. No. 4,516,501 issued May 14, 1985 to Held et al., and U.S. Pat. No. 5,544,589 issued Aug. 13, 1996 to Manfred Held are all hereby incorporated by reference herein as though fully set forth at length.

A selective fragmentation pattern of explosive material may be applied to any portion of a munition and selectively detonated to form stamped lines along which fragmentation occurs when the munition is exploded. Exemplary munitions comprise kinetic energy warheads comprising one or more multi-fragmenting warhead liners, mortars, artillery shells, grenades, mines, etc.

In one embodiment, portions of a pattern of explosive material may be selectively detonated to form different sizes of fragments in which the different sizes of fragments are selected to match lethality requirements for different targets. Portions of the selective fragmentation pattern are selected to produce larger fragments for armored targets requiring a higher lethality munition or smaller fragments for lightly armored or soft targets requiring a lower lethality munition.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION OF PREFERRED EMBODIMENTS

Figure 1:
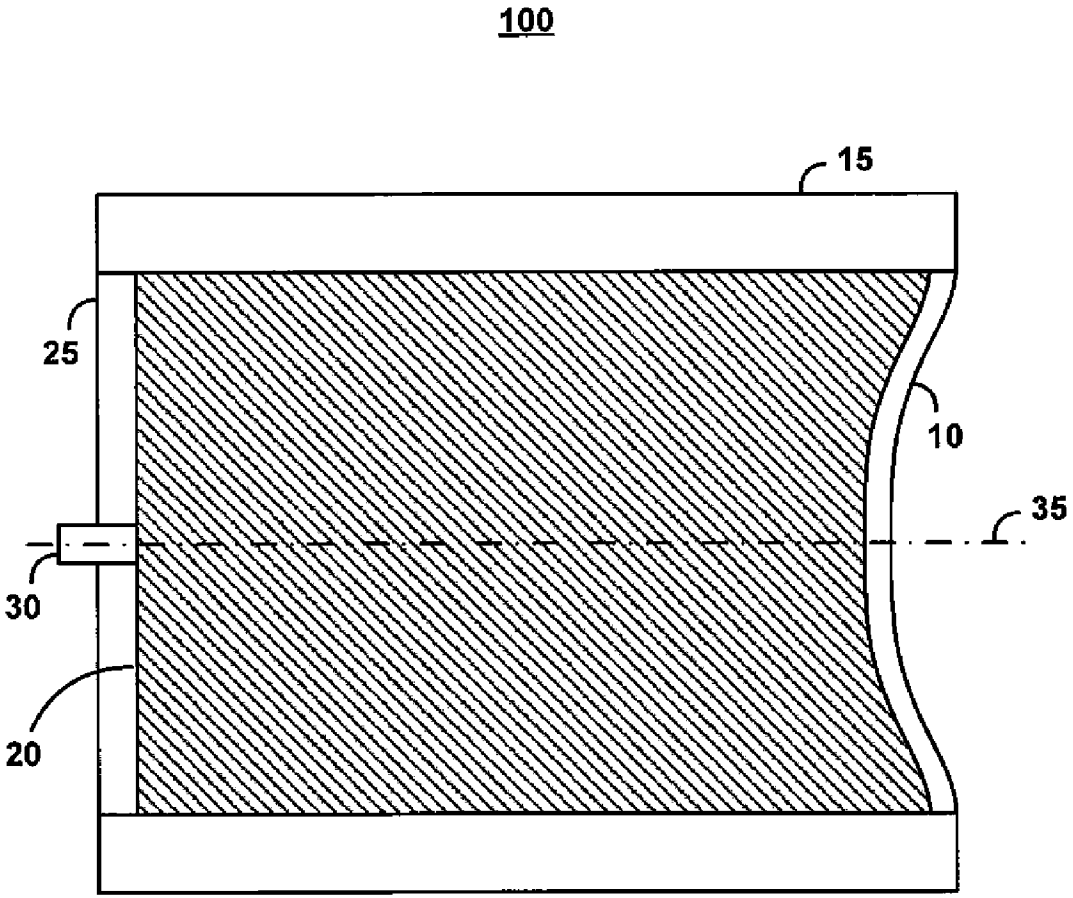
FIG. 1 is a cross-sectional view of single stage kinetic energy warhead utilizing a multi-fragmenting warhead liner that is selectively stamped with an explosive material.
Figure 2:
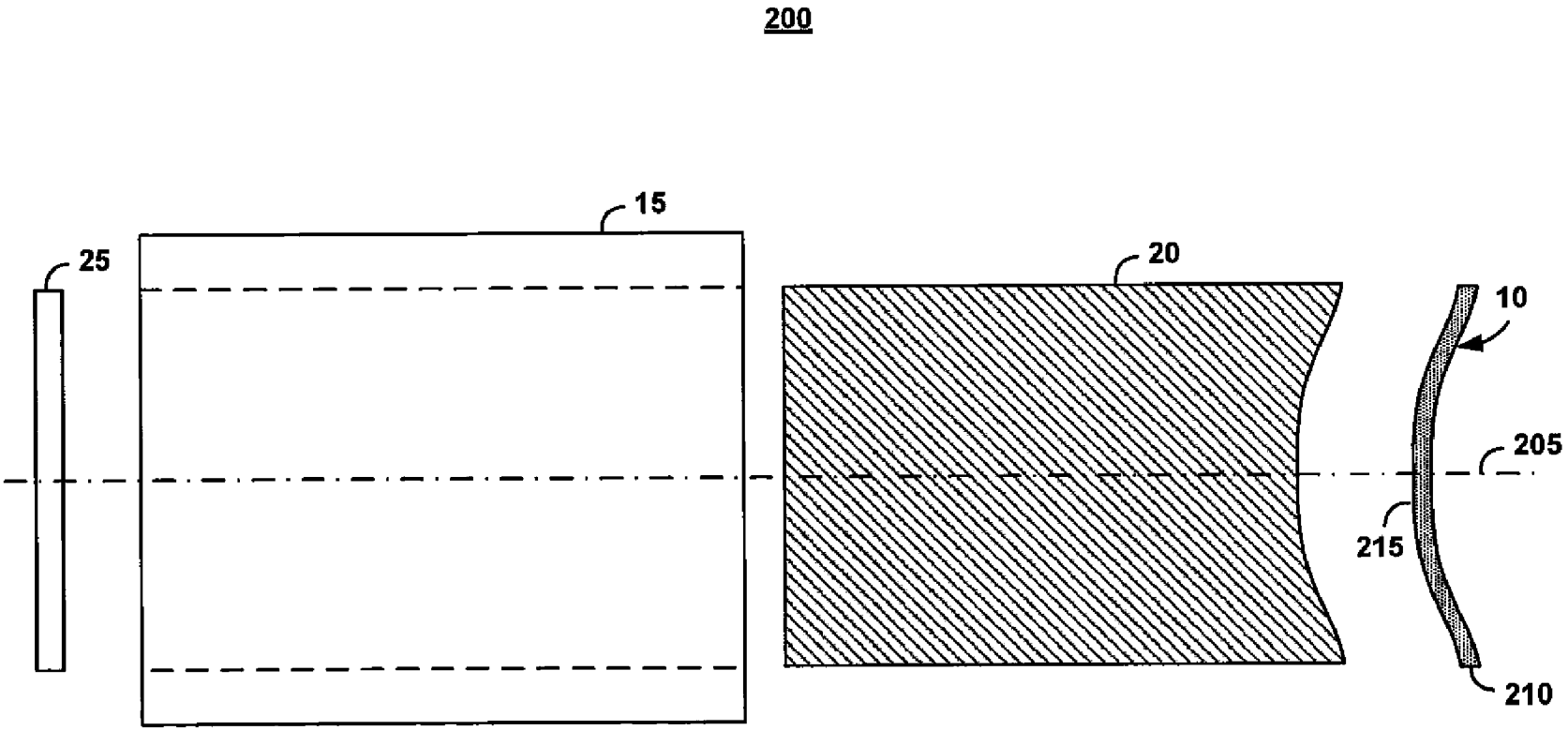
FIG. 2 is a cross-sectional exploded view of a projectile assembly of the explosively formed projectile warhead of FIG. 1.

FIGS. 1 and 2 illustrate an exemplary embodiment of a single-stage kinetic energy warhead 100 (also referred to herein as warhead 100) utilizing a multi-fragmenting warhead liner 10 that is explosively stamped. Warhead 100 generally comprises a metal housing, optional back plates, a main explosive charge 20, and an initiation mechanism assembly 30. FIG. 2 illustrates the projectile assembly 200 of warhead 100. The projectile assembly 200 generally comprises the main explosive charge 20, and the multi-fragmenting warhead liner 10.

The main explosive charge 20 comprises, for example, LX-14, OCTOL, hand packed C-4, or some other solid explosive, and is machined, cast, or hand-packed to fit snugly within the inside of the housing. In addition, the main explosive charge 20 is machined to comprise a countersunk recess in its forward end for receiving snug placement of the multi-fragmenting warhead liner 10.

Figure 3B:
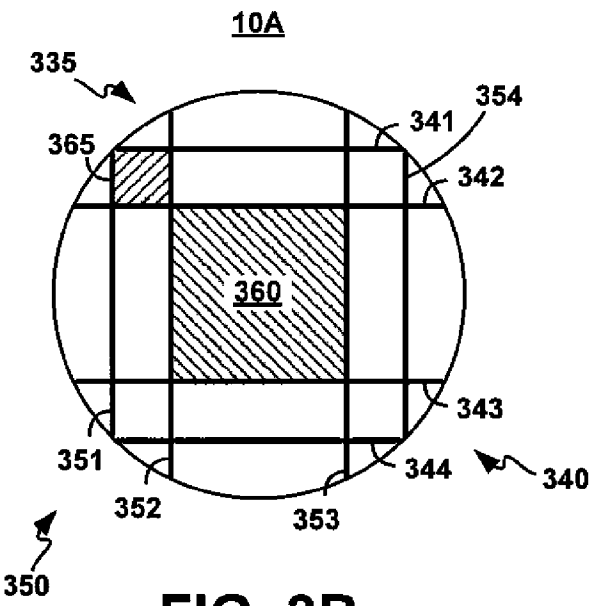
FIG. 3 is comprised of FIGS. 3A, 3B, and 3C, and represents a diagram of the multi-fragmenting warhead liner of FIGS. 1 and 2 with an exemplary selective fragmentation pattern applied with explosive material.
Figure 3A:
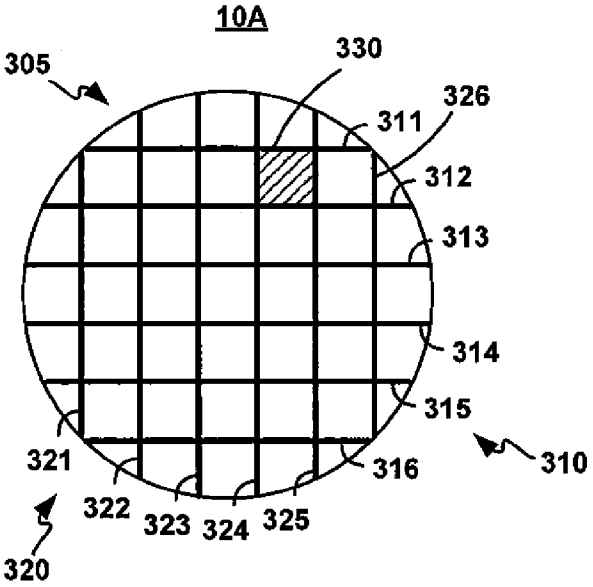

FIG. 3A illustrates a diagram of the multi-fragmenting warhead liner 10A with an exemplary selective fragmentation pattern 305 (interchangeably referenced herein as pattern 305) comprising explosive material. Pattern 305 comprises horizontal lines 310. The horizontal lines 310 comprise a horizontal line 311, a horizontal line 312, a horizontal line 313, a horizontal line 314, a horizontal line 315, and a horizontal line 316. Pattern 305 further comprises vertical lines 320. The vertical lines 320 comprise a vertical line 321, a vertical line 322, a vertical line 323, a vertical line 324, a vertical line 325, and a vertical line 326. Each of the horizontal lines 310 and the vertical lines 320 comprises explosive material. Individual lines of explosive material should be seen as individually ignited; the lines (and line segments) are separately ignited unless otherwise specified. Igniting one line or one segment of a line or one section will not automatically ignite all the other segments or lines, etc., unless pre-arranged to be electrically connected, unless otherwise stated the separate lines and segments thereof should be thought of as electrically insulated from one another, for purposes of discussion here. While pattern 305 is shown, for exemplary purposes only, comprising six horizontal lines 310 and six vertical lines 320, it should be clear that any number of lines in any configuration may be used in a selective fragmentation pattern.

When detonated, the ignited explosive material of pattern 305 stamps the surface of the multi-fragmenting warhead liner 10A. Exploding the warhead 100 fragments the multi-fragmenting warhead liner 10A along the ignited stamped lines, causing the multi-fragmenting warhead liner 10A to break into fragments, e.g., such as a section 330. Pattern 305 provides a number of sections of approximately equal size and equal lethality appropriate for lightly armored or soft targets.

Figure 9:
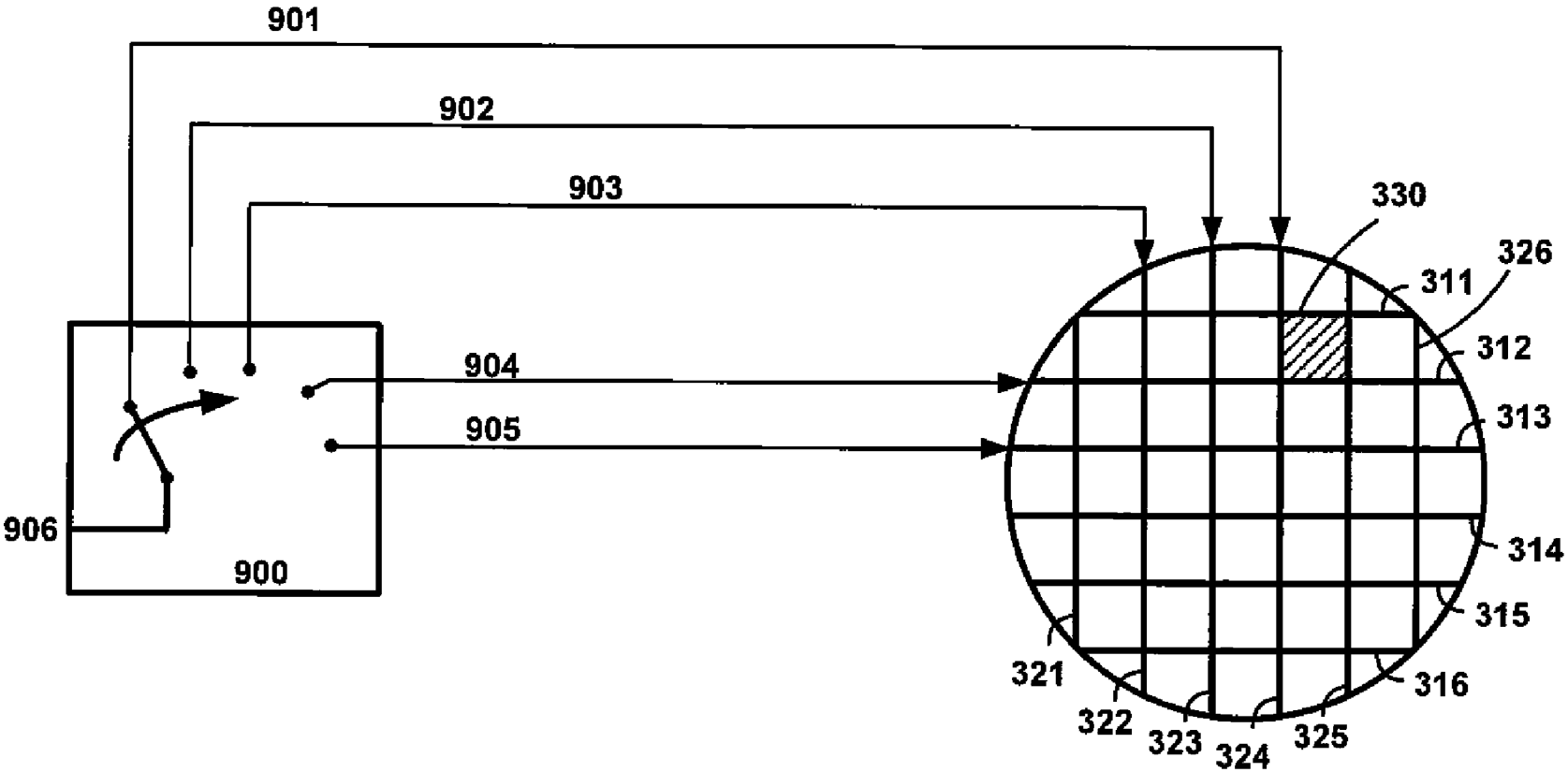
FIG. 9 illustrates individual vertical and horizontal lines of explosive material of FIG. 3A being selectively ignited; and, FIG. 10 illustrates individual radial and round circumferential lines of explosive material of FIG. 4A selectively ignited.

In one embodiment, portions of a pattern of explosive material may be selectively detonated to form different sizes of fragments in which the different sizes of fragments are selected to match lethality requirements of different targets. For example, FIG. 3B illustrates a selective ignition of the pattern 305 in which the explosive material of horizontal lines 311, 312, 315, 316, and vertical lines 321, 322, 325, and 326 are detonated; the explosive material of horizontal lines 313, 314 and vertical lines 323, 324 are not detonated. FIG. 9 helps show how the individual vertical and horizontal lines of explosive material of FIG. 3A, e.g., might be selectively ignited. There, each and every vertical and horizontal line may be individually selectively electrically connected, for example by electrical leads 901-905 (not all connections or details thereof are shown) to a selective ignition means 900 (details of which are not fully shown here). Means 900 simply allows a selected horizontal or vertical line (or segment thereof) to be connected to a source of electric current 906, as desired, through the electrical leads. Such flow of current along the lead causes immediate ignition of the explosive material along that selected line. Means 900 which could employ commonly available digital switch circuit means, could if desired be commanded from a processor/telemetry means which has determined a target and calculated/decided what type fragments to use against such target. Means 900 could also be manually operated to select lead lines for powering with current, or commanded manually from a ground station to a flying munition, for example.

The resulting selectively stamped pattern 335 is shown in FIG. 3B and comprises stamped horizontal lines 340 comprising a stamped horizontal line 341, a stamped horizontal line 342, a stamped horizontal line 343, and a stamped horizontal line 344. The selectively stamped pattern 335 further comprises stamped vertical lines 350 comprising a stamped vertical line 351, a stamped vertical line 352, a stamped vertical line 353, and a stamped vertical line 354. The "undetonated" horizontal lines 313, 314 and vertical lines 323, 324 are not shown in FIG. 3B.

The selectively stamped pattern 335 comprises sections ranging in size from a relatively large piece, a section 360, to smaller pieces such as a section 365. The larger size of section 360 is selected for more heavily armored targets, while the smaller size of section 365 is applicable for lightly armored or soft targets.

Figure 3C:
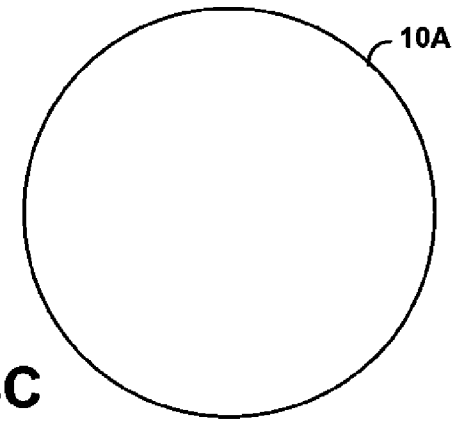

FIG. 3C illustrates a multi-fragmenting warhead liner 10A with none of the horizontal lines 310 or the vertical lines 320 detonated. Un-detonated horizontal lines 310 and vertical lines 320 are not shown in FIG. 3C. When fired, the warhead 100 launches the multi-fragmenting warhead liner 10A as a non-fragmented explosively formed projectile for maximum lethality of the warhead 100.

Consequently, selective ignition of pattern 305 enables variable and selective lethality of warhead 100 from maximum lethality of the whole multi-fragmenting warhead liner 10A to a reduced lethality of a fragment formed from section 330. All, some, or none of the explosive material of horizontal lines 310 and the vertical lines 320 may be selectively detonated to selectively vary the lethality of warhead 100. In one embodiment, selective ignition of pattern 305 is performed manually prior to deploying warhead 100. In another embodiment, selective ignition of pattern 305 is performed automatically by the warhead 100 before or after deployment of the warhead 100 in response to a manual determination of lethality requirements of a target. In yet another embodiment, selective ignition of pattern 305 is performed automatically by the warhead 100 before or after deployment of the warhead 100 in response to an automatic determination of lethality requirements of a target.

Figure 4A:
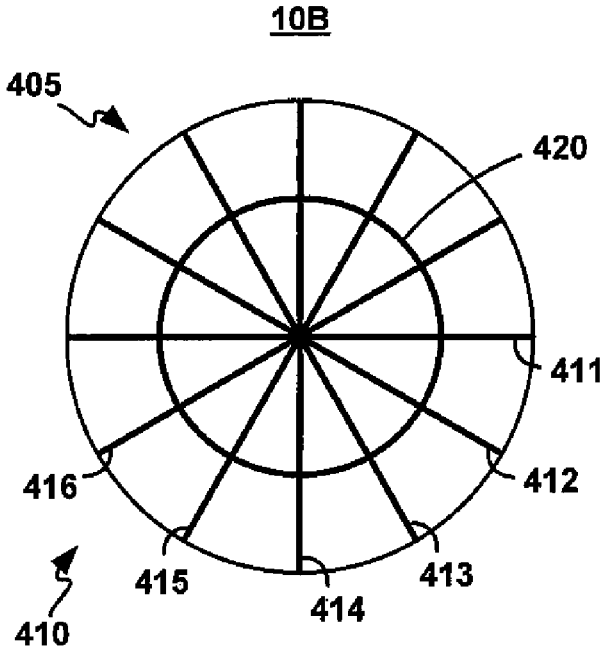
FIG. 4 is comprised of FIGS. 4A and 4B, and represents a diagram of the multi-fragmenting warhead liner of FIGS. 1 and 2 illustrating additional exemplary selective fragmentation patterns applied with explosive material.
Figure 4B:
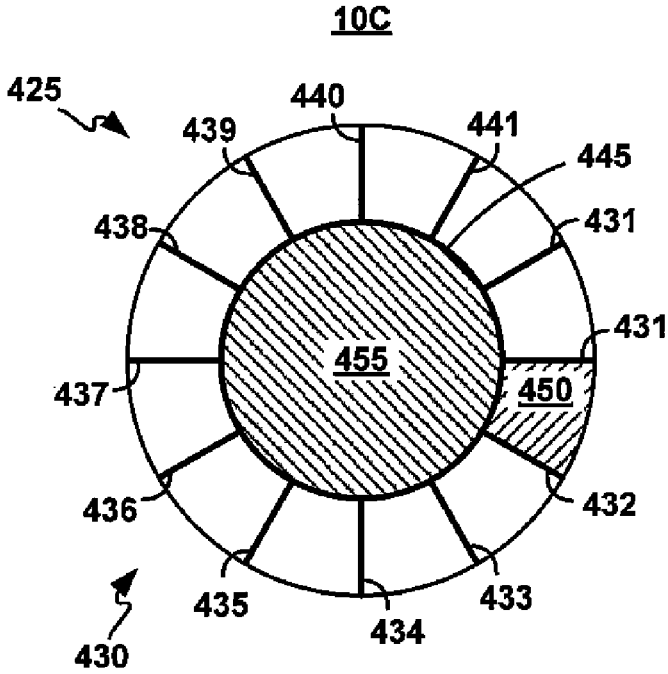

FIG. 4 (FIGS. 4A and 4B) illustrates exemplary additional patterns of explosive material applied to the multi-fragmenting warhead liner 10. In FIG. 4A, the multi-fragmenting warhead liner 10B comprises an exemplary selective fragmentation pattern 405 (interchangeably referenced herein as pattern 405) comprising explosive material. Pattern 405 comprises radial lines 410. The radial lines 410 comprise a radial line 411, a radial line 412, a radial line 413, a radial line 414, a radial line 415, and a radial line 416. Pattern 405 further comprises a circular line 420. The explosive material of the radial lines 410 and the circular line 420 may be selectively detonated to stamp any or all of the lines in pattern 405 on the multi-fragmenting warhead liner 10B. Individual lines of explosive material (circular lines or radial lines or segments thereof) should be understood as individually ignited; such lines (and line segments) are separately ignited unless otherwise specified. Igniting one line or one segment of a line or one section will not automatically ignite all the other segments or lines, etc., unless otherwise stated; they should be thought of as electrically insulated from one another, unless otherwise stated.

Figure 10:
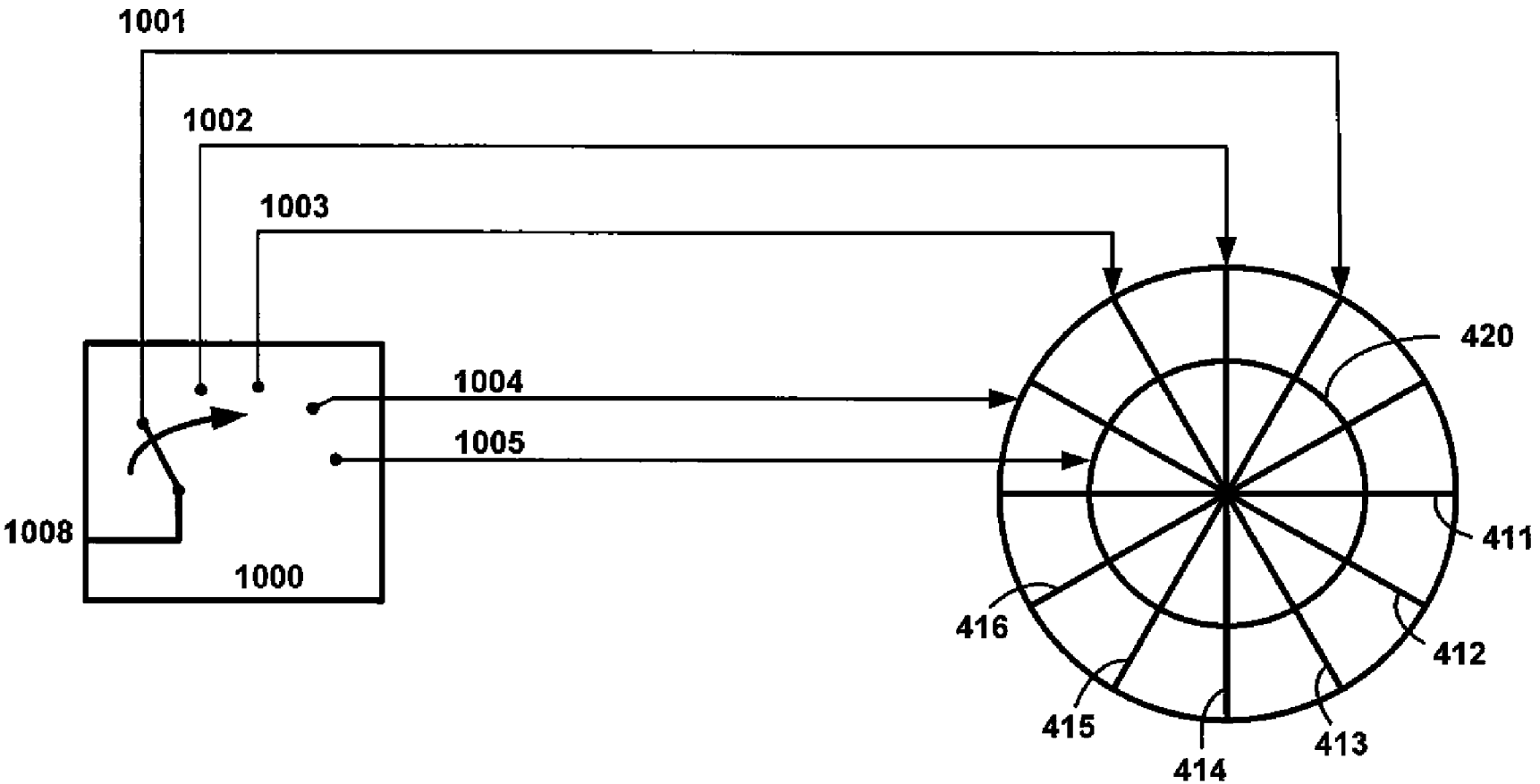

In FIG. 4B, the multi-fragmenting warhead liner 10C comprises an exemplary selective fragmentation pattern 425 (interchangeably referenced herein as pattern 425) comprising explosive material. Pattern 425 comprises radial segments 430. Radial segments 430 comprises a radial segment 431, a radial segment 432, a radial segment 433, a radial segment 434, a radial segment 435, a radial segment 436, a radial segment 437, a radial segment 438, a radial segment 439, a radial segment 440, and a radial segment 441. Pattern 425 further comprises a circular line 445. When warhead 100 is detonated, the multi-fragmenting warhead liner 10C fragments along the radial segments 430 and the circular line 445, forming fragments such as a fragment 450 and a center disk 455. The explosive material of the radial segments 430 and the circular segment may be selectively detonated to stamp any or all of the lines in pattern 425 on the multi-fragmenting warhead liner 10C. FIG. 10 helps show how the individual radial and circular lines of explosive material of FIG. 4A might be selectively ignited. There, each and every vertical and horizontal line is electrically connected along electrical lead lines such as 1001-1005 (not all connections or details thereof are shown) to a selective ignition means 1000 (details of which are not fully shown). Means 1000 simply allows a selected radial or circular line to be connected to a source of electric current 1008, as desired. Such flow of current causes immediate ignition of the explosive material along that selected line or circle. Means 1000 which could employ simple digital switch means, could if desired be commanded from a processor/telemetry means which has determined a target and decided what type fragments to use against such target. Means 1000 could also be manually operated to select lead lines for powering with current, or commanded manually from a ground station to a flying munition, e.g.

The explosive material may be applied to the multi-fragmenting warhead liner 10 by any appropriate means.

Figure 5A:
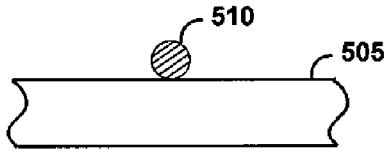
FIG. 5 is comprised of FIGS. 5A and 5B, and represents a cross-sectional diagram of a portion of the multi-fragmenting warhead liner of FIGS. 1 and 2 with explosive material applied and stamped after initiation of the explosive material.
Figure 5B:
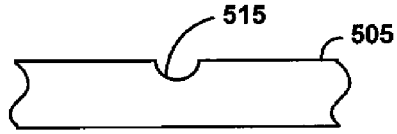

FIG. 5 (FIGS. 5A, 5B) illustrates a cross-section of a portion of the multi-fragmenting warhead liner 10 with explosive material applied (FIG. 5A) and stamped after the explosive material is detonated (FIG. 5B). A line of explosive material is shown for exemplary purposes as a "bead" 510. The application of explosive material may take any number of forms such as, for example, a bead, a flat line, etc. After ignition of the explosive material, a stamped "trench" 515 is formed. In one exemplary embodiment, bead 510 has the following preferred approximate ranges of dimensions 0.020" to 0.030"; and 0.020" to 0.030"; and a preferred depth of trench 515 ranges between approximately 0.015" to 0.020").

Figure 6:
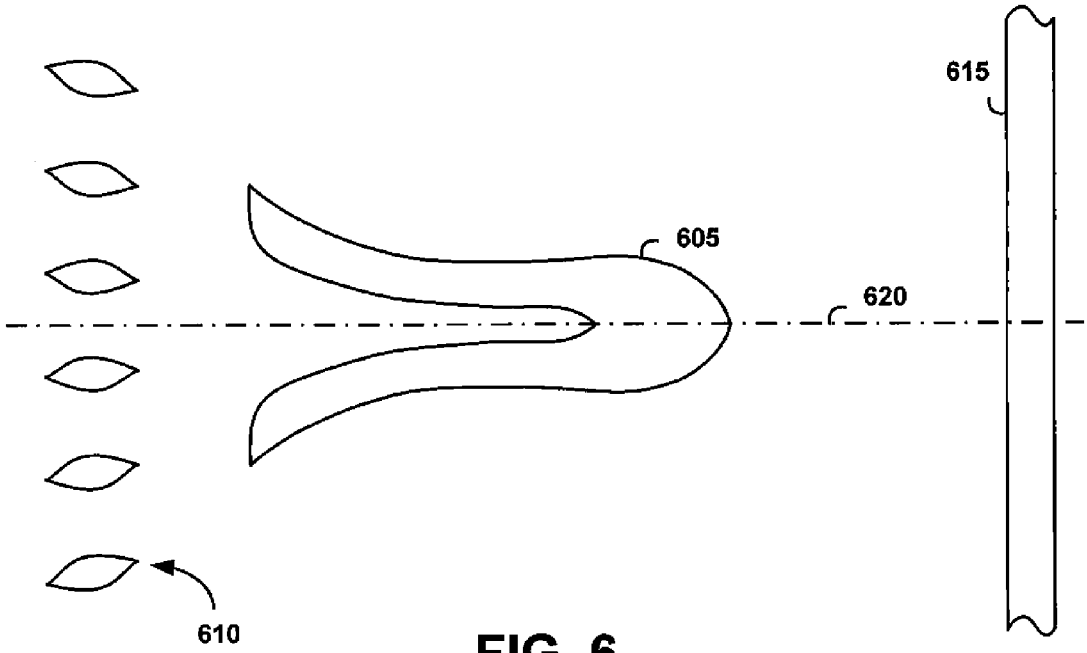
FIG. 6 is a cross-sectional view of an explosively formed projectile and fragments formed by firing the explosively formed projectile warhead of FIG. 1 comprising a multi-fragmenting warhead liner stamped by the explosive material with the selective fragmentation pattern of FIG. 3C.

FIG. 6 illustrates a cross-sectional view of an explosively formed projectile 605 and fragments 610 formed by firing the warhead 100 with the multi-fragmented warhead liner 10C (FIG. 4B) toward a target 615. With further reference to FIG. 1 and FIG. 4B, the detonator assembly 30 initiates the main explosive charge 20. A shockwave created by the detonation of the main explosive charge 20 propagates radially through the metal housing 15 toward the front of warhead 100. The shockwave breaks the multi-fragmented warhead liner 10C into fragments along the lines stamped by igniting the selective fragmentation pattern 425. These fragments comprise the center disk 455 and radial fragments such as the radial fragment 450. As illustrated by the diagram of FIG. 6, the center disk 455 is shaped along an axis 620 into the explosively formed projectile 605. Fragments 610 comprise fragments such as fragment 450.

A pattern of explosive material may be applied to any portion of a munition and selectively detonated to form stamped lines along which fragmentation occurs when the munition is exploded. Exemplary munitions include kinetic energy warheads comprising one or more multi-fragmenting warhead liners, mortars, artillery shells, grenades, mines, etc.

Figure 7:
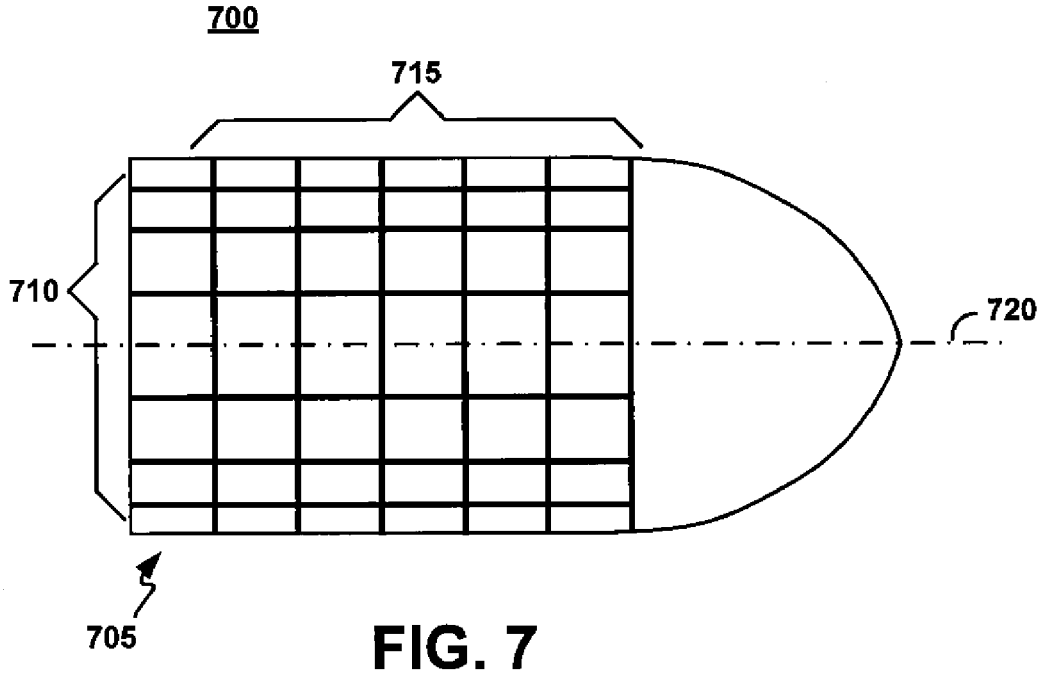
FIG. 7 is a cross-sectional view of a multi-fragmenting munition casing with an exemplary selective fragmentation pattern applied with the explosive material.

FIG. 7 illustrates a cross-sectional view of a multi-fragmenting mortar shell 700 comprising a selective fragmentation pattern 705 (interchangeably referenced herein as pattern 705) of explosive material. Pattern 705 is permanently applied to the interior of the multi-fragmenting mortar shell 700. Pattern 705 comprises longitudinal lines 710 and circumferential lines 715. The longitudinal lines 710 are applied parallel to a center axis 720. The circumferential lines 715 are applied to an interior circumference of the mortar shell 700. As previously described, when ignited, the explosive material of the selective fragmentation pattern 705 stamps (etches) into the interior surface of the mortar shell 700. When the mortar shell 700 is then later exploded, the mortar shell fragments along the stamped lines of the selective fragmentation pattern 705. Any number of lines in pattern 705 may be detonated to selectively stamp any portion of pattern 705, as may be desired.

Figure 8A:
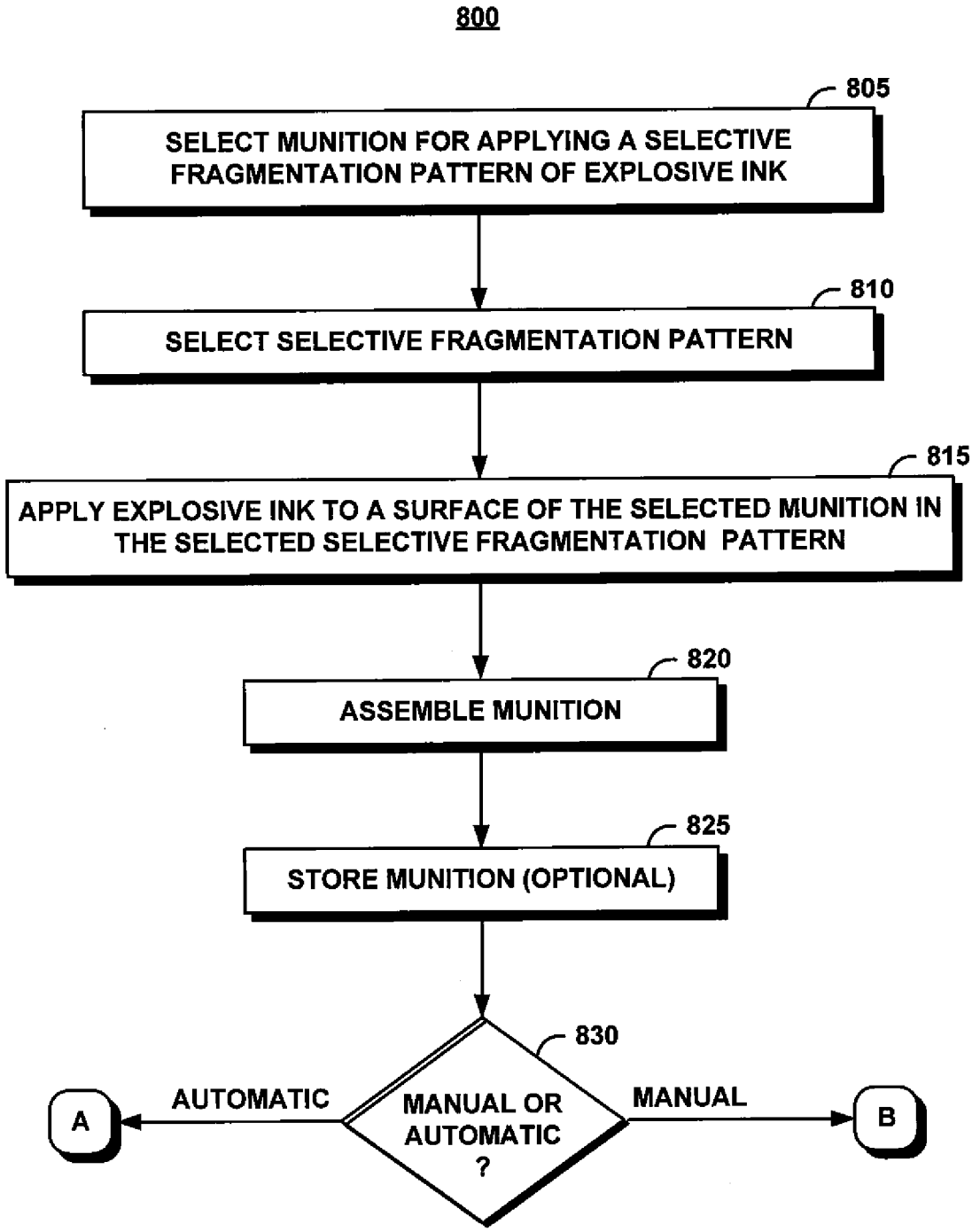
FIG. 8 is comprised of FIGS. 8A, 8B, and 8C and represents a process flow chart illustrating use of an explosively stamped selective fragmentation pattern to fragment a munition according to the selective fragmentation pattern when the munition is exploded.
Figure 8B:
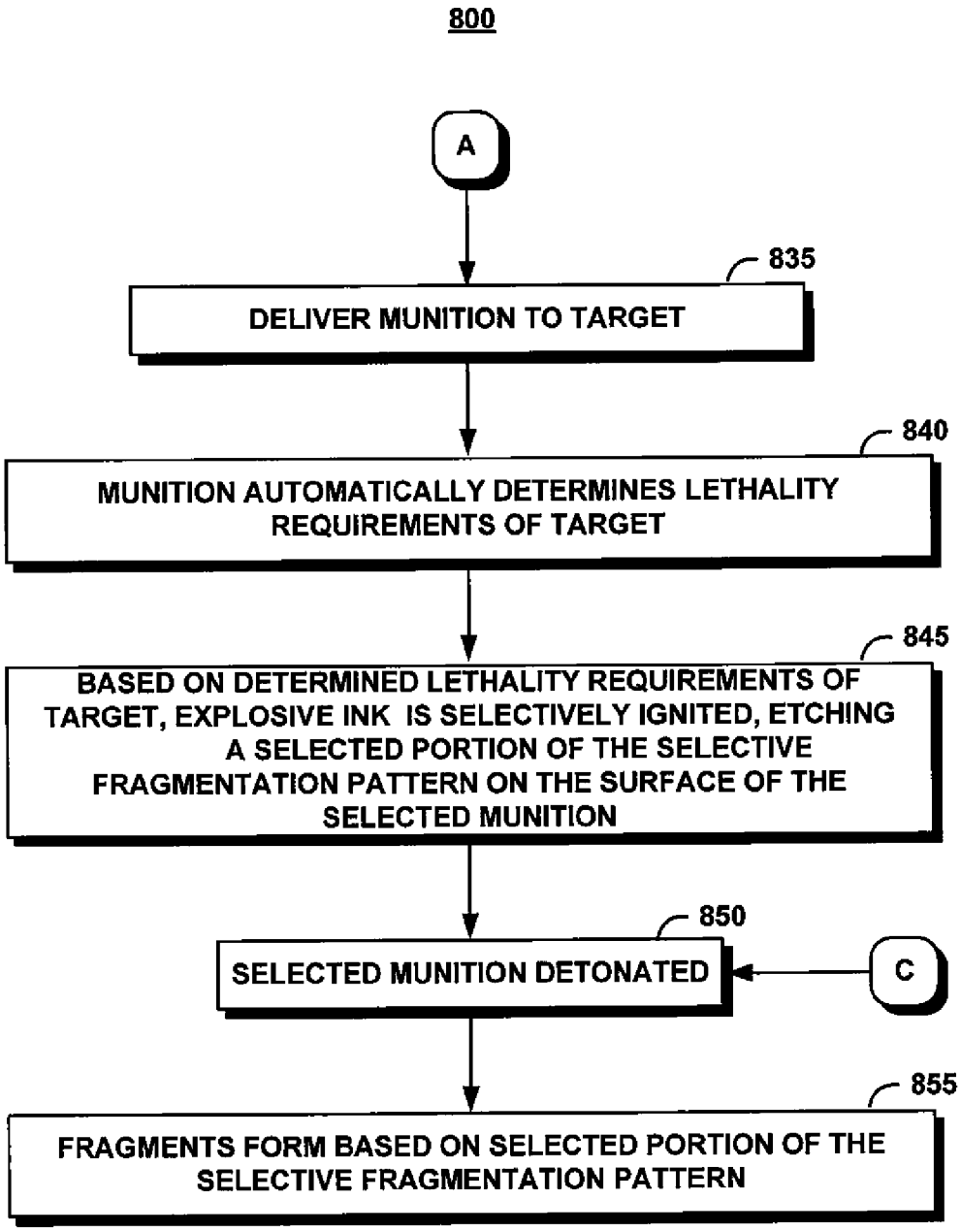
Figure 8C:
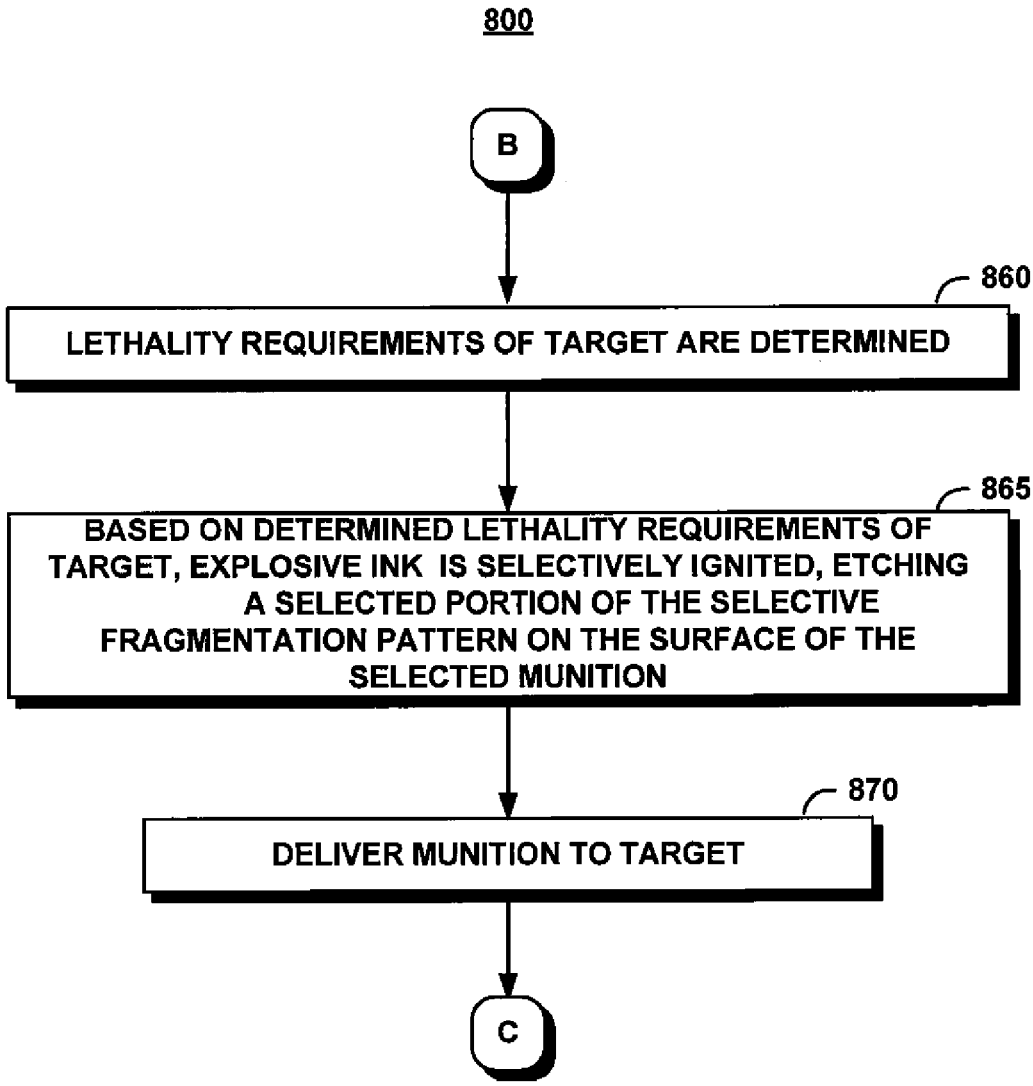

FIG. 8 illustrates a method 800 of utilizing an explosively stamped selective fragmentation pattern to fragment a munition according to the selective fragmentation pattern when the munition is exploded. A munition is selected for application of explosively stamped selective fragmentation pattern (step 805). The selective fragmentation pattern is selected (step 810). The explosive material is painted onto a surface of the selected munition in the selected selective fragmentation pattern (step 815), and left to dry. The munition is assembled (step 820) and optionally stored (step 825).

Method 800 branches at decision step 830 based on manual or automatic selective ignition of the explosive material the selective fragmentation pattern. If selective ignition is automatic, the munition is delivered to a target (step 835). Delivery to a target comprises launching a grenade, deploying a mine or kinetic energy weapon, launching a mortar, etc. The munition automatically determines the lethality requirements of the target (step 840). Based on the lethality requirements of the target, the explosive material of the selective fragmentation pattern is selectively detonated, stamping a selected portion of the selective fragmentation pattern on the surface of the selected munition (step 845). The munition is detonated (step 850) and fragments are formed based on the selected portion of the selective fragmentation pattern (855).

If selective ignition is manual, a user determines the lethality requirements of the target (step 860). Based on the lethality requirements of the target, the user selectively ignites the explosive material of the selective fragmentation pattern, stamping a selected portion of the selective fragmentation pattern on the surface of the selected munition (step 865). The munition is delivered to the target (step 870), and method 800 returns to step 850. As previously described, the selected munition is detonated (step 850) and fragments are formed based on the selected portion of the selective fragmentation pattern (855).

FIG. 9 as described elsewhere above, illustrates individual vertical and horizontal lines of explosive material of FIG. 3A being selectively ignited; and, FIG. 10 as described elsewhere above, illustrates individual radial and round circumferential lines of explosive material of FIG. 4A selectively ignited.

It is to be understood that the specific embodiments of the invention that have been described are merely illustrative of certain applications of the principle of the present invention. Numerous modifications may be made to the system and method for explosively stamping a fragmentation pattern described herein without departing from the spirit and scope of the present invention.

What is claimed is:

1. A fragmenting munition in which certain fragmentation lethality outcomes can be preselected, comprising a main explosive charge and a munition shell having an inside surface upon which is permanently painted explosive material in geometric line patterns corresponding to such desired lethality outcomes for fragmentation of the munition shell, and wherein selective ignition of portions or all of the explosive material will burn a selected pattern of etchings on the inside surface of the munition shell, and wherein such etchings are done in an already fully manufactured and assembled munition at a time which is prior to detonation of the main explosive charge, and wherein upon detonation of the main explosive charge, a fragmentation of the munition shell will generally follow the selected etching patterns, wherein the said time is prior to launch of the munition.

2. The fragmenting munition of claim 1, wherein the explosive material can be applied in a line having height and width in approximate ranges of dimensions 0.020 inches to 0.030 inches; and can burn an etching into a depth of ranges between approximately 0.015 inches to 0.020 inches.

3. The fragmenting munition of claim 1, wherein the desired lethality is to produce larger sized fragments for attacking armored vehicle type targets.

4. The fragmenting munition of claim 1, wherein the desired lethality is to produce smaller sized fragments for attacking personnel type targets.

5. The fragmenting munition of claim 1, wherein the munition comprises any of an explosively formed projectile warhead, a mortar, and an artillery shell.

6. The fragmenting munition of claim 1, wherein the explosive material comprises explosive ink.

7. The fragmenting munition of claim 1, comprising an explosively formed projectile (EFP).

* * * * *